United States Patent [19]

Krautkrämer

[11] Patent Number: 4,533,062

[45] Date of Patent: Aug. 6, 1985

[54] CONTAINER CLOSURE FOR SUPPLYING AIR TO OR REMOVING AIR FROM A CONTAINER

[75] Inventor: Günter Krautkrämer, Budenheim, Fed. Rep. of Germany

[73] Assignee: Jacob Berg KG, Bundenheim, Fed. Rep. of Germany

[21] Appl. No.: 640,031

[22] Filed: Aug. 10, 1984

[30] Foreign Application Priority Data

Aug. 11, 1983 [DE] Fed. Rep. of Germany ..... 3328953

[51] Int. Cl.[3] ..... B65D 51/22

[52] U.S. Cl. ..... 220/258; 220/203; 220/367

[58] Field of Search ..... 220/202, 203, 209, 258, 220/366, 367, 270

[56] References Cited

U.S. PATENT DOCUMENTS 2,907,489 10/1959 Taylor ..... 220/258
3,458,080 7/1969 Laurizio ..... 220/258
4,327,842 5/1982 Walter ..... 220/367
4,442,949 4/1984 Dwinell et al. ..... 220/258

*Primary Examiner*—George T. Hall
*Attorney, Agent, or Firm*—Michael L. Dunn

[57] ABSTRACT

A container closure made from plastics, for supplying air to or removing air from a container, comprising a closure lower portion which can be connected to the container and has a diaphragm portion which comprises one piece with said lower portion, closes the pouring opening and can be torn out, and a cap which can be detachably connected to the closure lower portion characterized in that the diaphragm portion has a resilient diaphragm with an opening which in the normal position of the diaphragm portion is sealed in an airtight manner by a projection of the container closure abutting with the opening, wherein the diaphragm of the diaphragm portion is prestressed against the projection of the container closure, and a hollow space of the cap adjoining the opening is in open connection with the atmosphere.

20 Claims, 4 Drawing Figures

CONTAINER CLOSURE FOR SUPPLYING AIR TO OR REMOVING AIR FROM A CONTAINER

Figure 1:
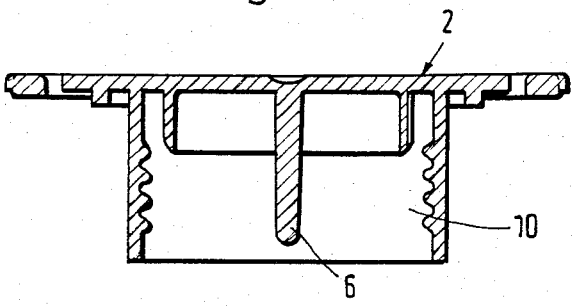

The invention relates to a container closure made from plastics comprising a closure lower portion which can be connected to the container and has a diaphragm portion which comprises one piece with said lower portion, closes the pouring opening and can be torn out, and a cap which can be detachably conneced to the closure lower portion. Container closures having these features are known to be used for keeping a fluid container sealed in a fluid-tight manner during storage. Before utilization the diaphragm portion sealing the pouring opening is then perforated or preferably torn out after which closure can only be obtained with the aid of the cap which can be screwed onto or inserted on the lower portion of the closure or connected thereto in another way.

There are fluid filling materials which for manufacturing reasons are filled into containers at high temperatures. If in this case the containers are made from relatively thin-walled flexible materials such as tin plate or plastics and if these containers are hermetically sealed directly after filling, i.e. before the filling material cools off, then a vacuum is created inside the container during the cooling process which can lead to deformations of the container casing (implosion, panelling).

In other cases fluids have to be filled into containers which fluids when the ambient temperatures are high, for example when they are stored in rooms having high temperatures such as during summertime, have a vapour pressure that is increased to such an extent that the aforementioned containers made from relatively thin-walled flexible materials likewise undergo deformation in that they bulge outwards.

The problem underlying the invention was therefore to obtain a container closure which in the event of excess pressure or low pressure in the container would supply air to or remove air from the container as the case may be, but which during storage would only provide a connection with the atmosphere during the airing or ventilating but which was otherwise sealed in a gas-tight and fluid-tight manner. In particular a container closure of this kind should be made completely from plastics material and from a manufacturing point of view should be able to be produced as easily as possible. To this end it should comprise as few individual members as possible so that its manufacture necessitates the minimum of spraying processes.

The plastics container closure according to the invention for supplying air to or removing air from a container and having the features described at the outset is characterised in that the diaphragm portion has a resilient diaphragm with an opening which in the normal position is sealed in a gas-tight manner by a projection of the container closure abutting with the opening, wherein the diaphragm is prestressed against the projection of the container closure, and a hollow space of the cap adjoining the opening is in open connection with the atmosphere.

Due to the fact that the diaphragm is prestressed against the projection of the container closure the interior of the container remains sealed in a fluid-tight and gas-tight manner with respect to the atmosphere during storage. This is particularly significant when the filling material has a relatively high vapour pressure or is susceptible to oxidation. Depending upon whether the container closure is intended to supply air to the container or remove air from said container the resilient diaphragm lifts itself off the projection of the container closure when the pressure in the container is low or excessive thereby exposing the opening in the diaphragm for gas to pass therethrough and the interior of the container to be aired or ventilated as appropriate until the internal pressure corresponds with the external pressure once more. At this point in time the diaphragm comes to rest in a prestressed manner against the projection of the container closure once more and thus seals the opening.

The opening is therefore only ever open for a short period of time for the purposes of airing or ventilating and during storage under normal conditions is sealed in a gas-tight and fluid-tight manner. Furthermore, the opening can be kept very small since only relatively small amounts of gas must pass through it to enter or leave the container.

In order that the container closure can operate for the purposes of airing or ventilating despite the cap which is connected to the lower portion of the closure the cap has an interior hollow space directly adjoining the opening, which space is in open connection with the atmosphere by way of an air passage so that in the case of ventilating air or vapour passing out through the opening into the hollow space of the cap can pass out through the air passage into the atmosphere and in the case of airing air can be sucked in through the air passage when the diaphragm is lifted off the projection of the container closure.

In keeping with the features set out above as being fundamental to the invention the container closure according to the invention can be embodied in different ways. According to an expedient embodiment the projection of the container closure can be connected with the can and can for example take the form of a pin which is connected in one piece with the cap, reaches from above as far as the diaphragm and abuts with the diaphragm in the normal position. The opening is hereby expediently arranged centrally in the diaphragm and the pin centrally in the cap. In the same manner the opening and the pin could nevertheless be arranged excentrally. The projection can also be annular in shape for example.

In another expedient embodiment the projection sealing the opening can be arranged on the lower portion of the closure. To this end the diaphragm member may expediently be provided with a web arranged diametrically thereon and having a pin attached thereto which depending upon the task it is required to fulfil abuts with the opening from above or from below. If it abuts from above the container closure can be used for airing, if it abuts from below the closure can be used for ventilating. The operating principle is the same in both cases.

Naturally, the projection sealing the opening does not need to be a pin but can also be a rib or a part having any other random shape. However, a pin with a rounded free end provides a particularly effective seal so that this embodiment is preferred.

The open connection of the interior hollow space of the cap with the atmosphere can have differing forms from a constructional point of view. For example, the lid portion of the cap can have an opening. It is preferable, however, to provide an air passage between the adjacent surfaces of the cap on the one side and the lower portion of the closure on the other side. When the container closure according to the invention is intended, for example, during the filling of filling materials at high temperature to permit airing only after the filling process during the cooling process then the air passage between the cap and the lower portion of the closure can be arranged in such a way that it only provides an open connection with the atmosphere when the cap is not fully screwed on firmly or connected in another way firmly with the lower portion of the closure but by a further partial turn then seals itself. Since the diaphragm portion effects a completely sealed closure during the storage of the container it is unimportant that at the same time there is no complete seal against gas between the cap and the lower portion of the closure. When the diaphragm is then removed prior to utilization the cap will be firmly screwed on when the container is closed once more whereby in the case of the latter arrangement and construction of the air passage this passage is closed so that the gas-tight seal between the cap and the lower portion of the closure is then produced.

When mention is made here of a diaphragm portion which can be torn out this can also be taken to include a diaphragm which is cut out or perforated. It is preferred, however, to provide the diaphragm portion in a manner known per se along its entire outer periphery with weak points or with continuous material wakening so that it is easy to remove in its entirety. To facilitate the removal the diaphragm portion is provided with a tearing ring into which the index finger can be inserted in order to tear out the diaphragm portion.

The diaphragm portion itself can likewise have different forms. Thus it can simply comprise the diaphragm. Expediently, however, it has a substantially rigid web member extending all around and a resilient diaphragm surrounded by this web and forming one piece therewith. The above-mentioned tearing ring is then secured to the web. A diaphragm portion of this kind can easily be completely removed from the pouring opening by a jerky tearing out movement.

The lower portion of the closure is able in a manner known per se to be connected to the container in different ways such as by engaging, screwing, welding, flanging of the rim of the container or otherwise. The cap can also be detachably secured to the lower portion of the closure in differing and known ways such as by screwing on, inserting on, bayonette closure or the like.

The invention is further described by the drawing, wherein

Figure 2:
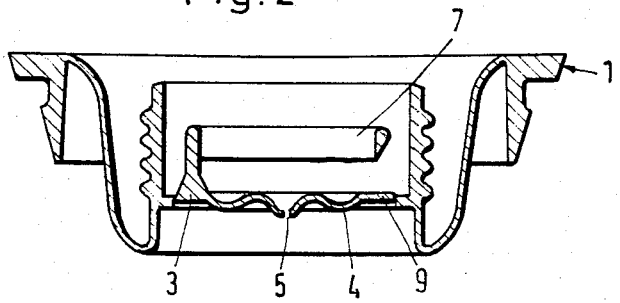
Figure 3:
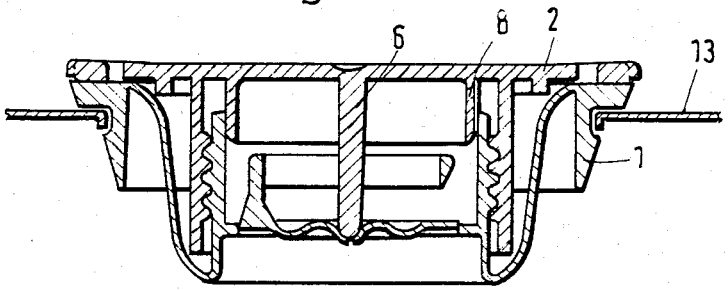
Figure 4:
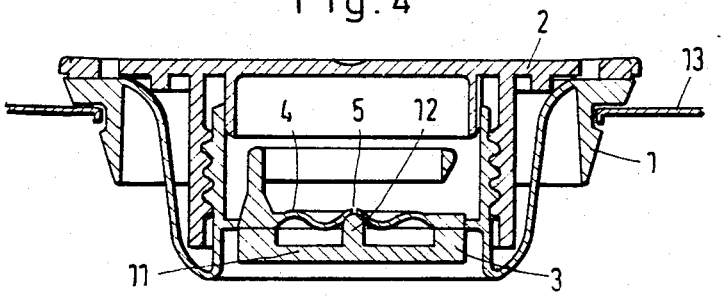

FIG. 1 is a vertical section through the cap of a preferred embodiment of a container closure according to the invention for airing, FIG. 2 is a vertical section through the lower portion of the closure of the cap according to FIG. 1, FIG. 3 is a vertical section through the assembled container closure comprising the individual members of FIGS. 1 and 2 and connected to the container opening and FIG. 4 is a vertical section through another embodiment of a container closure in the manner of representation shown in FIG. 3, wherein this container closure is designed for ventilating.

Identical parts have the same construction and the same reference numerals in both embodiments, FIGS. 1 to 3 on the one hand and FIG. 4 on the other hand.

Each of the container closures has a closure lower portion 1 and a cap 2, each of which is made in one piece from a plastics material. The closure lower portion 1 has a diaphragm portion 3 which in the case of the embodiment according to FIGS. 1 to 3 comprises a substantially rigid web 9 extending annularly, a tearing ring 7 secured thereto and a resilient diaphragm 4 surrounded by the substantially rigid web 9. All these component members of the diaphragm portion are connected in one piece with one another.

In the centre the diaphragm 4 has an opening 5 which in the case of the embodiment according to FIGS. 1 to 3 is sealed in the normal position by a pin 6 of the cap 2 which is rounded at its free end. By virtue of the flexibility of the diaphragm 4 and the height adjustment between the diaphragm and the pin 6 the diaphragm 4 lies against the pin 6 with a certain amount of prestressing. Now, when a low pressure situation occurs in the interior of the container the higher atmospheric pressure lifts the diaphragm 4 off the pin 6, air flows through the opening 5 into the interior of the container until in practice pressure equalization is attained between the atmospheric pressure and the pressure in the interior of the container. Then the diaphragm 4 comes to lie against the pin 6 again under prestressing thereby sealing the opening 5 once more.

The connection between the opening 5 and the outside atmosphere is obtained by means of a small air passage between the cap 2 and the closure lower portion 1. The interior hollow space of the cap 2 which adjoins the opening 5 has the reference numeral 10. In FIGS. 3 and 4 the wall of the container upon which the container closure according to the invention was mounted has the reference numeral 13.

The container closure according to the invention illustrated in FIG. 4 for ventilating differs from the closure according to FIGS. 1 to 3 in that no pin is provided in the cap for sealing the opening 5 but that the diaphragm portion 3 has in addition to the annularly extending web 9, the tearing ring 7 and the diaphragm 4 with its central opening 5 a diametrically arranged web 11 which is secured on both sides, by welding, adhesion or engaging for example, to the annularly extending web 9 and has a pin 12 secured in one piece thereto. In this embodiment the pin 12 lies against the opening 5 of the diaphragm 4 from below so that in the event of excess pressure in the container the diaphragm lifts itself upwards off the pin and in this way ventilates the container.

In order to open the container closure prior to utilization the cap 2 is removed in the conventional way, for example screwed off, and the diaphragm portion 3 is torn out with the aid of the tearing ring 7.

What is claimed is:

1. A container closure made from plastics, for supplying air to or removing air from a container, comprising a closure lower portion which can be connected to the container and has a diaphragm portion which comprises one piece with said lower portion, closes the pouring opening and can be torn out, and a cap which can be detachably connected to the closure lower portion characterised in that the diaphragm portion has a resilient diaphragm with an opening which in the normal position of the diaphragm portion is sealed in an air-tight manner by a projection of the container closure abutting with the opening, wherein the diaphragm of the diaphragm portion is prestressed against the projection of the container closure, and a hollow space of the cap adjoining the opening is in open connection with the atmosphere.

2. The container closure according to claim 1, characterised in that the projection is a pin which is connected with the cap and abuts with the opening from above.

3. The container closure according to claim 1, characterised in that the projection is a pin attached to the diaphragm portion which can be torn out, by way of a substantially rigid connection member and abuts with the opening from above or below.

4. The container closure according to claim 1 characterised in that the diaphragm portion has a tearing ring.

5. The container closure according to claim 2 characterised in that the diaphragm portion has a tearing ring.

6. The container closure according to claim 3 characterised in that the diaphragm portion has a tearing ring.

7. The container closure according to claim 1 characterised in that the diaphragm portion comprises a substantially rigid, annularly extending web and a resilient diaphragm comprising one piece with said web.

8. The container closure according to claim 2 characterised in that the diaphragm portion comprises a substantially rigid, annularly extending web and a resilient diaphragm comprising one piece with said web.

9. The container closure according to claim 3 characterised in that the diaphragm portion comprises a substantially rigid, annularly extending web and a resilient diaphragm comprising one piece with said web.

10. The container closure according to claim 4 characterised in that the diaphragm portion comprises a substantially rigid, annularly extending web and a resilient diaphragm comprising one piece with said web.

11. The container closure according to claim 5 characterised in that the diaphragm portion comprises a substantially rigid, annularly extending web and a resilient diaphragm comprising one piece with said web.

12. The container closure according to claim 6 characterised in that the diaphragm portion comprises a substantially rigid, annularly extending web and a resilient diaphragm comprising one piece with said web.

13. The container closure according to claim 1 characterised in that the hollow space of the cap adjoining the diaphragm portion is in open connection with the atmosphere by way of an air passage between the closure lower portion and the cap.

14. The container closure according to claim 2 characterised in that the hollow space of the cap adjoining the diaphragm portion is in open connection with the atmosphere by way of an air passage between the closure lower portion and the cap.

15. The container closure according to claim 3 characterised in that the hollow space of the cap adjoining the diaphragm portion is in open connection with the atmosphere by way of an air passage between the closure lower portion and the cap.

16. The container closure according to claim 4 characterised in that the hollow space of the cap adjoining the diaphragm portion is in open connection with the atmosphere by way of an air passage between the closure lower portion and the cap.

17. The container closure according to claim 6 characterised in that the hollow space of the cap adjoining the diaphragm portion is in open connection with the atmosphere by way of an air passage between the closure lower portion and the cap.

18. The container closure according to claim 7 characterised in that the hollow space of the cap adjoining the diaphragm portion is in open connection with the atmosphere by way of an air passage between the closure lower portion and the cap.

19. The container closure according to claim 8 characterised in that the hollow space of the cap adjoining the diaphragm portion is in open connection with the atmosphere by way of an air passage between the closure lower portion and the cap.

20. The container closure according to claim 9 characterised in that the hollow space of the cap adjoining the diaphragm portion is in open connection with the atmosphere by way of an air passage between the closure lower portion and the cap.

* * * * *